United States Patent [19]

Clarke

[11] Patent Number: 4,834,339

[45] Date of Patent: May 30, 1989

[54] HYDRAULIC JACK SYSTEM

[76] Inventor: Ward Clarke, Box 279, Wynantskill, N.Y. 12198

[21] Appl. No.: 144,246

[22] Filed: Jan. 14, 1988

[51] Int. Cl.[4] ..... B66F 3/24

[52] U.S. Cl. ..... 254/93 R; 254/133 R; 254/DIG. 1; 254/DIG. 3

[58] Field of Search ..... 254/93 R, 93 H, 133 R, 254/DIG. 1, DIG. 3, DIG. 4

[56] References Cited

U.S. PATENT DOCUMENTS

| | | | |
|---|---|---|---|
| 1,590,830 | 6/1926 | Jewkes | 254/93 R |
| 3,806,091 | 4/1974 | Wride | 254/93 R |
| 4,194,726 | 3/1980 | Hance | 254/133 R |
| 4,262,881 | 4/1981 | Gray | 254/93 R |
| 4,641,815 | 2/1987 | Yu | 254/93 H |

*Primary Examiner*—William L. Sikes
*Assistant Examiner*—B. R. R. Holloway
*Attorney, Agent, or Firm*—Kane, Dalsimer, Sullivan, Kurucz, Levy, Eisele & Richard

[57] ABSTRACT

A hydraulic jack system used for lifting and lowering heavy loads such as machine tools comprises a lower cylindrical member, a solid ram member mounted within the cylindrical member and an outer sleeve member having affixed thereto a lifting slab and fitting over the lower cylindrical member. A hydraulic injection hose forces fluid into the lower cylindrical tube causing the ram member to rise and thus lift the outer sleeve member and the flange on which the load rests. The hydraulic injection hose has an adjustable valve which allows not only for injecting fluid at a rate to raise the ram member and thus the load as quickly as desired, but also allows fluid to flow back through the fluid injection hose at a desired rate such as to lower the load through the force of gravity as quickly as desired. Also affixed to the base of the system are a pair of handles which function to allow the jack to be carried about and also prevent rotation of the outer sleeve member such that a notch in it sits over the fluid injection hose.

4 Claims, 2 Drawing Sheets

HYDRAULIC JACK SYSTEM

BACKGROUND OF THE INVENTION

1. Field of the Invention

This invention relates to a hydraulic jack system for lifting such heavy loads as machine tools, buildings, etc.

2. Description of the Prior Art

Although hydraulic jack systems have of course existed in the past, a need has remained for such a system which will lift and lower heavy loads efficiently and with adjustable speed.

OBJECTIVES AND SUMMARY OF THE INVENTION

It is a primary objective of the invention to provide a hydraulic jack system for lifting and lowering heavy loads which does so in an efficient manner and also which is adjustable as to the speed of lifting and lowering.

These and other objects and advantages of the invention will become apparent from the following description.

The hydraulic system of the present invention comprises a base upon which is mounted a cylindrical member. Fitting within the hole of the cylindrical member is a solid ram member. Another cylindrical member fits as an outer sleeve over the cylindrical member attached to the base and has attached to it a flange upon which the load to be lifted can be mounted.

A hose is attached to the cylindrical member affixed to the base for injecting hydraulic fluid (wc) therein. The hose has an adjusting valve. Injection of hydraulic fluid through the tube into the cylindrical member affixed to the base forces the solid ram member to rise carrying with it the outer sleeve member and thus the flange carrying the load.

Other features of the hydraulic system include a pair of handles for moving the jack into various positions around the load. A notch exists in the outer sleeve member such that it fits over the hydraulic injection hose when in a lowered position. One of the functions of the handles is to prevent the outer sleeve member from turning so as to shear off the hydraulic injection hose.

The valve on the injection hose functions not only to allow hydraulic to enter the cylindrical member affixed to the base so as to raise the ram member as quickly as desired, but also functions to allow hydraulic fluid to escape back through the hydraulic injection hose so as to allow the lowering of the load through the force of gravity as soon as possible.

DESCRIPTION OF THE PREFERRED EMBODIMENT

Figure 1:
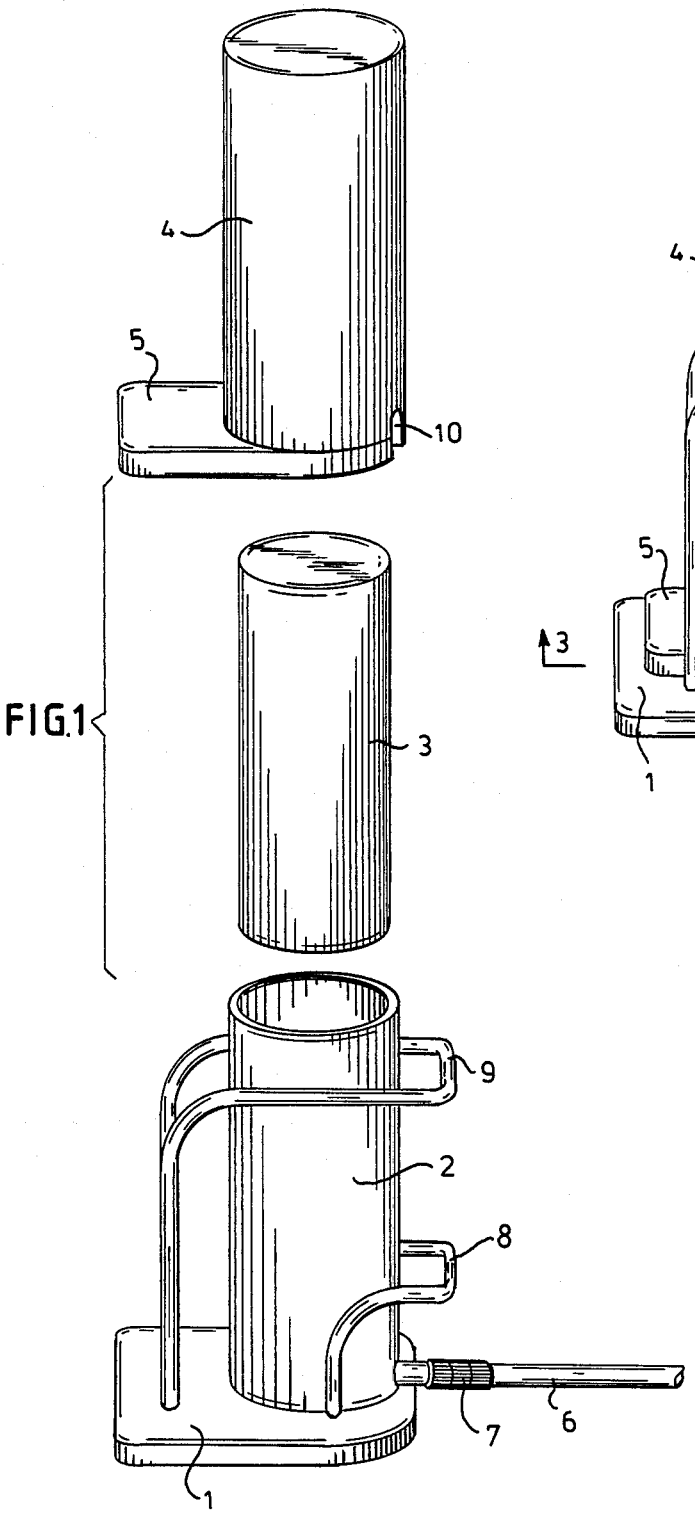
FIG. 1 is an exploded view of the hydraulic jack system of the present invention.

As shown in FIG. 1, the hydraulic jack system companies a base 1 to which is affixed a hollow cylindrical member 2. The jack also comprises a solid ram member 3 which abuts against the top of outer sleeve 4. Also shown in FIG. 1 are a flange 5 attached to sleeve 4 on which the load to be lifted rests, and a tube 6 having a valve 7 through which air is injected to lift the ram member and thus the outer sleeve member 4 containing the loading flange 5.

FIG. 1 also shows handles 8 and 9 which functions to allow the jack to be carried from place to place around a load. Another function of the handles is to prevent the outer sleeve member 4 from turning so that the notch 10 therein fits directly over the hydraulic injection hose 6 such that the member 4 cannot shear the hose.

An important feature of valve 7 is that it not only allows fluid to be injected at a rate considered to be desirable to lift the ram member and thus the load at the desired speed, but it also opens to allow fluid to escape backward through the injection hose 6 so as to allow the load to descend by the force of gravity at a desired speed.

Figure 2:
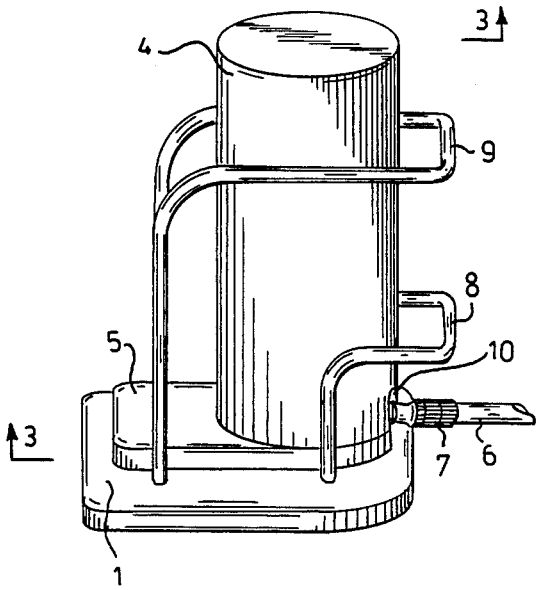
FIG. 2 is a perspective view of the hydraulic jack system of the present invention when the outer sleeve member is in a lowered position.

FIG. 2 shows the apparatus of FIG. 1 with the outer sleeve member being in a lowered condition. Like reference numerals for the same elements are used as in FIG. 1.

Figure 3:
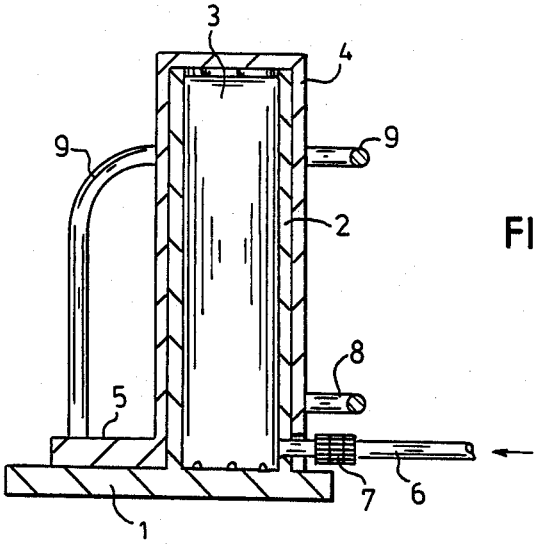
FIG. 3 is a sectional view of the hydraulic jack system shown in FIG. 2.

FIG. 3 shows a sectional view of the jack system of FIG. 1 with the outer sleeve member and consequently the load being in a lowered position. Like reference numerals are used for the same elements as shown in FIG. 1.

Figure 4:
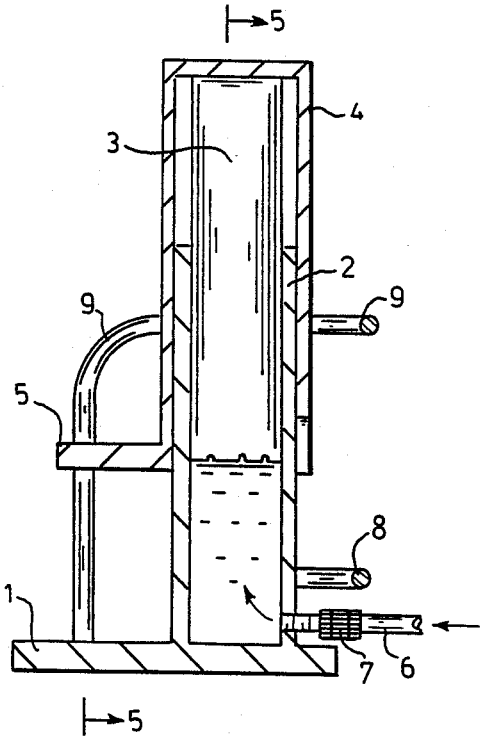
FIG. 4 is a sectional view of the hydraulic jack system with the outer sleeve and ram members being raised under the force of injected hydraulic fluid.

FIG. 4 shows a sectional view of the jack of FIG. 1 with the ram member and consequently the load flange 5 being in a raised position. Again, like reference numerals are used for the same elements in previous drawings.

Figure 5:
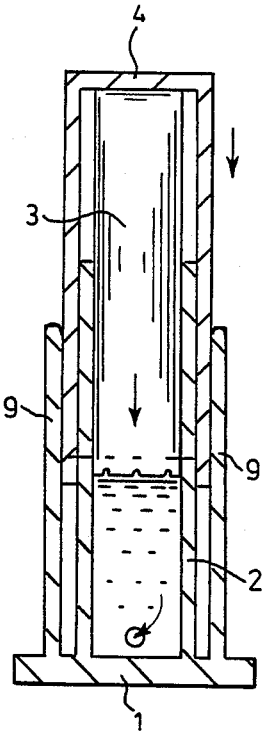
FIG. 5 is a sectional view of the hydraulic jack system shown in FIG. 4 taken along the lines 5—5 in FIG. 4.

FIG. 5 shows a sectional view of the jack as shown in FIG. 4 taken along the lines 5—5. Again, like reference numerals designate the same elements as in the previous drawings. As illustrated, the handles 9 are tightly fitted with the outer sleeve member 4 which functions to prevent the outer sleeve member 4 from turning and thus maintaining the notch 10 in alignment with the hydraulic injection hose 6. Thus the invention as shown herein before provides not only the capability for lifting heavy loads such as machine tools in an efficient fashion, but also provides the capability for adjusting the speed with which the loads are lifted and lowered.

While a preferred embodiment of the invention has been shown herein, it should be noted that other embodiments of the invention are covered by the scope of the appended claims.

What is claimed is:

1. A hydraulic jack system comprising:

a base;

a hollow cylindrical member mounted on said base;

a solid ram member which fits within said hollow cylindrical member;

an outer sleeve member which fits over said hollow cylindrical member and whose top rests upon said solid ram member;

a flange affixed to said outer sleeve member and functioning to serve as a platform for a load; and means for raising said solid ram member and consequently said outer sleeve member and said load, said raising means comprising a single conduit connected to the interior of said hollow cylindrical member to facilitate fluid flow into said hollow cylindrical member to raise said load and out of said hollow cylindrical member to lower said load.

2. The hydraulic jack system of claim 1 wherein said single conduit is a hydraulic injection hose connected to the interior of said hollow cylindrical member.

3. The hydraulic jack system of claim 2 wherein said single conduit further comprises said fluid injection hose having a valve functioning to allow said load to be raised as fluid flows through said single conduit into said hollow cylindrical member and to lower said load at a desired rate as fluid flows out of said hollow cylindrical member and into said single conduit.

4. The hydraulic jack system of claim 2 further comprising at least one handles mounted on said base and said outer sleeve having a notch with said at least one handles functioning to prevent said outer sleeve from turning and thus maintaining said notch in alignment with said hydraulic injection hose.

* * * * *